US010786101B2

(12) United States Patent
Miyamoto

(10) Patent No.: US 10,786,101 B2
(45) Date of Patent: Sep. 29, 2020

(54) PILLOW USING MAGNESIUM BASED SOLID METAL PARTICLES AS FILLER

(71) Applicant: MIYAMOTO CORPORATION, Koga-shi, Ibaraki (JP)

(72) Inventor: Takashi Miyamoto, Koga (JP)

(73) Assignee: MIYAMOTO CORPORATION, Koga-shi, Ibaraki (JP)

( * ) Notice: Subject to any disclaimer, the term of this patent is extended or adjusted under 35 U.S.C. 154(b) by 0 days.

(21) Appl. No.: 16/340,724

(22) PCT Filed: Jan. 30, 2017

(86) PCT No.: PCT/JP2017/003214
§ 371 (c)(1),
(2) Date: Apr. 10, 2019

(87) PCT Pub. No.: WO2018/138920
PCT Pub. Date: Aug. 2, 2018

(65) Prior Publication Data

US 2019/0313816 A1 Oct. 17, 2019

(51) Int. Cl.
*A47G 9/10* (2006.01)
*A47G 9/00* (2006.01)

(52) U.S. Cl.
CPC ..... *A47G 9/1036* (2013.01); *A47G 9/007* (2013.01); *A47G 9/10* (2013.01)

(58) Field of Classification Search
CPC ..... A47C 9/007; A47C 9/10; A47C 9/1036; A47C 2009/004; A47C 27/122; A47C 27/16; A61K 35/02
See application file for complete search history.

(56) References Cited

U.S. PATENT DOCUMENTS 4,535,002 A * 8/1985 Kirkhuff ..... C04B 26/02 156/276
4,680,822 A * 7/1987 Fujino ..... A61N 5/06 5/421

(Continued)

FOREIGN PATENT DOCUMENTS

JP 48-007318 U 1/1973
JP 60-164978 U 11/1985

(Continued)

OTHER PUBLICATIONS

International Search Report of PCT/JP2017/003214 dated Feb. 28, 2017 [PCT/ISA/210].

(Continued)

*Primary Examiner* — David R Hare
(74) *Attorney, Agent, or Firm* — Sughrue Mion, PLLC

(57) ABSTRACT

The present invention addresses the problem of providing a pillow which enables a user to sleep well. To solve this problem, this pillow uses, as a filler, magnesium (Mg) based solid metal particles which are light and have high heat conductivity to enable the user to sleep well by stably holding the user's head and by increasing heat release property from the pillow. Additionally, the user's head can be stably held and heat release property from the pillow further increases by using a pillowcase which has excellent air permeability and cushioning properties and which has a three-dimensional knit structure composed of two layers of knit fabric including an outer knit fabric and an inner knit fabric and a connecting thread that connects the two layers of knit fabric.

7 Claims, 3 Drawing Sheets

(56) References Cited

U.S. PATENT DOCUMENTS

| | | | | | |
|---|---|---|---|---|---|
| 6,026,330 | A * | 2/2000 | Chuang | A47G 9/007 | 5/421 |
| 6,027,777 | A * | 2/2000 | Hirano | A47G 9/10 | 428/137 |
| 2004/0241366 | A1* | 12/2004 | Ishida | A47G 9/10 | 428/36.1 |
| 2005/0060807 | A1* | 3/2005 | Kaizuka | A47G 9/007 | 5/636 |
| 2013/0183495 | A1* | 7/2013 | Rock | D06M 11/50 | 428/156 |
| 2013/0341819 | A1* | 12/2013 | Liang | A47G 9/0215 | 264/103 |
| 2014/0039082 | A1* | 2/2014 | Peterson | C08J 9/0066 | 521/170 |

FOREIGN PATENT DOCUMENTS

| | | | | |
|---|---|---|---|---|
| JP | 08-080239 | A | | 3/1996 |
| JP | 2004-180936 | A | | 7/2004 |
| JP | 2005-152480 | A | | 6/2005 |
| JP | 2005152480 | A | * | 6/2005 |
| JP | 2012-000196 | A | | 1/2012 |
| JP | 2012000196 | A | * | 1/2012 |
| WO | 2006/028032 | A1 | | 3/2006 |

OTHER PUBLICATIONS

Notification of Reasons for Refusal of Japanese Application No. 2017-513558 dated Nov. 1, 2017.

Notification of Reasons for Refusal of Japanese Application No. 2017-513558 dated Jun. 8, 2017.

Decision to Grant a Patent of Japanese Application No. 2017-513558 dated Apr. 9, 2018.

Communication dated Aug. 2, 2019, from the State Intellectual Property Office of People's Republic of China in counterpart Application No. 201780065710.4.

* cited by examiner

PILLOW USING MAGNESIUM BASED SOLID METAL PARTICLES AS FILLER

CROSS REFERENCE TO RELATED APPLICATIONS

This application is a National Stage of International Application No. PCT/JP2017/003214, filed Jan. 30, 2017.

TECHNICAL FIELD

The present invention relates to a pillow filled with a filler which enables a user to sleep well.

BACKGROUND ART

A pillow is used to fill a gap between bedclothes and a user's head by deformation and to hold the head stably in order for the user to sleep well. As a filler for the pillows, flexible fillers such as a cotton, a feather and a urethane foam and flowable particulate fillers such as a buckwheat husk and a synthetic resin pipe are conventionally used.

As a pillow using the particulate filler, a pillow which enables a user to sleep well by not only holding the user's head stably but releasing heat accumulated in the pillow has been proposed. For example, Patent Document 1 discloses a pillow using a synthetic resin material coated with a metal as a filler. Patent Document 2 discloses a pillow using a hollow ball made of a metal such as iron and copper as a filler.

PRIOR ART DOCUMENT

Patent Documents

Patent Document 1: JP H08-080239 A
Patent Document 2: JP 2012-000196 A

SUMMARY OF INVENTION

Problems to be Solved by the Invention

The principal problem to be solved by the present invention is to provide a pillow which enables a user to sleep well by holding the user's head stably and discharging heat accumulated in the pillow.

Means for Solving the Problems

In order to solve the above problem, inventors of the present invention studied keenly and achieved the present invention. The summary of the invention is described as below.

(1) A pillow including a pillow body having a layer filled with a particulate filler containing magnesium based solid metal particles as at least a top surface layer and a pillowcase covering the pillow body.

(2) The pillow according to (1), wherein the solid metal particle contains substantially 100 wt % magnesium.

(3) The pillow according to (1) or (2), wherein an average particle size of the solid metal particles is 1.0 to 5.0 mm.

(4) The pillow according to any one of (1) to (3), wherein a proportion of the solid metal particles in the particulate filler is 50 vol % to 100 vol %.

(5) The pillow according to any one of (1) to (4), wherein the particulate filler contains magnesium based solid metal particles and particles having cushioning properties.

(6) The pillow according to any one of (1) to (5), wherein the pillow body has a layer filled with the particulate filler containing the magnesium based solid metal particles as a top surface layer, and has a layer having cushioning properties on a back surface side of the top surface layer as a back surface layer.

(7) The pillow according to any one of (1) to (6), wherein the pillowcase has a three-dimensional knit structure which is formed of two layers of knit fabric which are an outer knit fabric and an inner knit fabric and a connecting thread connecting the two layers of knit fabric.

(8) The pillow according to (7), wherein an interval of the knitted stitches in the inner knit fabric in the three-dimensional knit structure is equal to or smaller than a half the smallest particle size of the particulate filler.

Effects of the Invention

The pillow of the present invention is provided with the layer filled with the particulate filler containing magnesium based solid metal particles (hereinafter, also referred to as "Mg solid particles";"solid metal particles without a hollow portion") as at least the top surface layer of the pillow body, thereby it can hold a user's head stably because the particulate filler moves and deforms in accordance with a shape of the user's head, and can cool the user's head by excellent heat release property of the Mg solid particles.

Further, in the pillow of the present invention, the pillowcase having a three-dimensional knit structure which is excellent in air permeability and cushioning properties and is formed of two layers of knit fabric, i.e. the outer knit fabric and the inner knit fabric and the connecting thread connecting the two layers of knit fabric is used. Thereby, functions of holding the user's head stably and cooling the user's head can be further improved.

MODES FOR CARRYING OUT THE INVENTION

Figure 1:
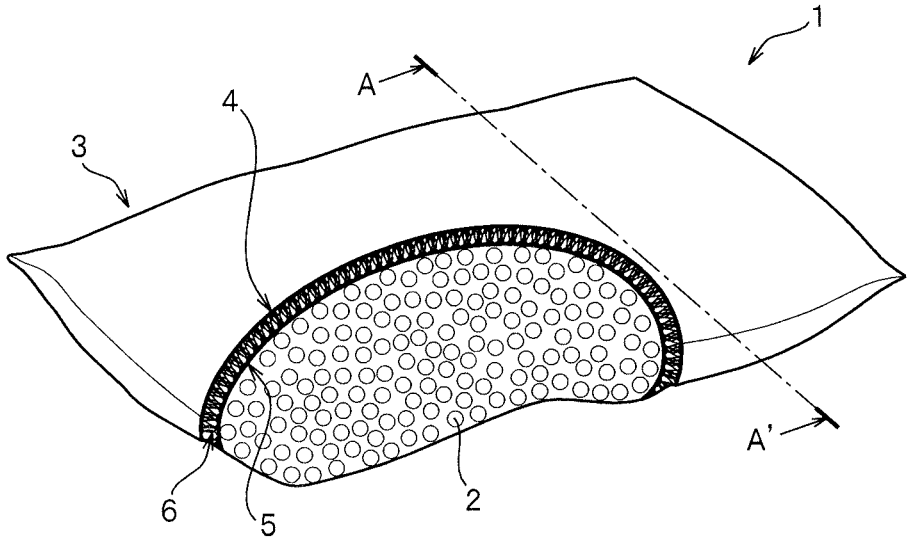
FIG. 1 is a perspective view illustrating a first embodiment of the pillow in the present invention including a partial cross-sectional view.

The present invention relates to a pillow which enables a user to sleep well by a function of holding the user's head stably and a function of cooling the user's head by heat release. Specifically, the invention relates to a pillow provided with a pillow body having a layer filled with a particulate filler containing Mg solid particles as at least a top surface layer and a pillowcase covering the pillow body, and preferably the pillowcase having a three-dimensional knit structure which is excellent in air permeability and cushioning properties and is formed of two layers of knit fabric, i.e. an outer knit fabric and an inner knit fabric and a connecting thread connecting the two layers of knit fabric.

As mentioned above, for a filler to releasing heat accumulated in the pillow, a synthetic resin material coated with a metal is used in the Patent Document 1, and a hollow ball made of metal such as iron and copper is used in the Patent Document 2. However, such particulate fillers cannot have sufficiently high heat release property of the pillow because heat conductivity of the synthetic resin material is low and the hollow part of the hollow metal ball has heat insulating property.

The inventors of the present invention found that by using the Mg solid particles which is lightweight and has good heat conductivity as a filler for the pillow, the function of cooling the user's head by heat release can be sufficiently enhanced without increasing a weight of the pillow, thereby accomplished the present invention.

Further, the inventors also found that by using a three-dimensional knit structure formed of two layers of knit fabric which are the outer knit fabric and the inner knit fabric and the connecting thread connecting the two layers of knit fabric as a pillowcase, cushioning properties and air permeability of the pillow are improved, and the function of holding the user's head stably and the function of cooling the user's head can be further improved.

Also the Mg solid particle contained in the filler of the pillow in the present invention is lightweight and easy to use, and further, generates a small amount of hydrogen gas by reacting with moisture such as the user's sweat, thereby further promotion of sound sleep can be expected by the small amount of hydrogen gas.

Hereinafter, the pillow of the present invention will be described in more detail using FIGS. 1 to 4.

In the present invention, directions are determined as below.

<Definition in the Vertical Direction>

When the user uses the pillow, a direction contacting the user's head is a top surface side, and the opposite side is a back surface side in the vertical direction.

<Definition in the Horizontal Direction>

When the user uses the pillow, a direction of the user's body in the horizontal direction is an upper and lower direction, and the direction of the user's legs is a lower direction, and the opposite direction is an upper direction. Also, a direction orthogonal to the upper and lower direction in the horizontal direction is a right and left direction, and when the pillow is observed from the top surface side, the right-hand direction of the observer is a right direction, and the left-hand direction of the observer is a left direction.

The first feature of the present invention is to use the Mg solid particle which is lightweight and has good heat conductivity as a filler of the pillow, as described above.

Figure 2:
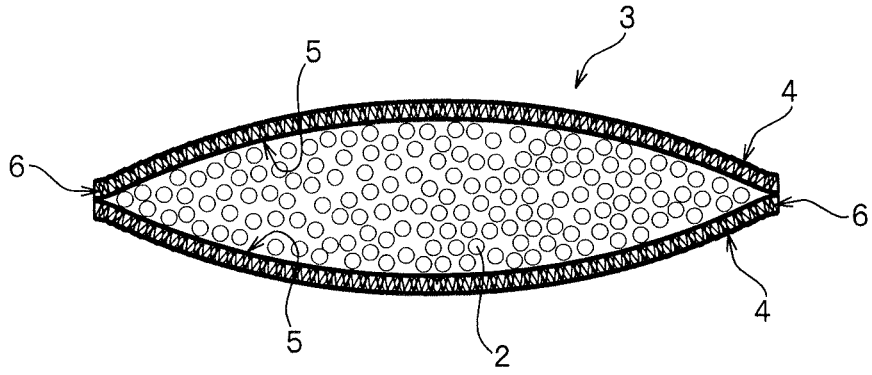
FIG. 2 is a cross-sectional view of the pillow along the A-A' line in FIG. 1.

The first embodiment of the pillow in the present invention is shown in FIGS. 1 and 2. The pillow 1 in the first embodiment is formed of a particulate filler 2 containing Mg solid particles and a pillowcase 3 covering the filler 2.

When the synthetic resin material coated with the metal disclosed in Patent Document 1 or the hollow ball made of metal such as iron and copper disclosed in Patent Document 2 is used as a filler of the pillow, the heat release property of the pillow cannot be sufficiently enhanced because the heat conductivity of the synthetic resin material is low, and the hollow part of the hollow metal ball has heat insulating property. However, in the present invention, using Mg solid particles having specific weight at 1.74 which is lightweight (specific weight of iron: 7.87, specific weight of copper: 8.96) and good heat conductivity as high as 159 W/m·K (heat conductivity of iron: about 75 W/m·K, heat conductivity of copper: about 390 W/m·K) as a filler of the pillow, heat release property of the pillow can be sufficiently enhanced without increasing the weight of the pillow.

"Magnesium based solid metal particle (Mg solid particle)" in the present invention means a solid metal particle containing magnesium (Mg) at a relatively high ratio, and in view of not significantly lowering lightness or heat release property of the pillow, specifically the particle preferably contains 50 wt % or more magnesium, more preferably 80 wt % or more, and the most preferably substantially 100 wt % ("substantially" means "in a case that impurities which cannot be removed by generally known purifying means adopted in production sites are excluded from content of the magnesium particle").

As a metal content other than magnesium which "magnesium based solid metal particle (Mg solid particle)" of the present invention can contain includes:

1) metal impurities contained in magnesium ore or accompanied in a purification step and a processing step of magnesium such as iron (Fe), aluminum (Al) and zinc (Zn), and 2) metal not significantly lowering lightness of the pillow or heat release property of the pillow.

As a metal other than magnesium which the solid metal particle contains, aluminum (specific weight: 2.70, heat conductivity: 230 W/m·k) can be favorably used because heat conductivity of aluminum is a little higher although specific weight of aluminum is a little higher than magnesium.

An average particle size of the solid metal particles used in the invention is preferably 1.0 to 5.0 mm, more preferably 2.0 to 4.0 mm and the most preferably 2.5 to 3.5 mm in view of lightness of the pillow, heat release property of the pillow, stable holding property for a user's head and touch feeling of the user. When the average particle size is smaller than 1.0 mm, heat release property of the pillow and touch feeling of the user are favorable, but lightness of the pillow and stable holding property for a user's head are deteriorated. When the average particle size exceeds 5.0 mm, lightness of the pillow and stable holding property for a user's head are favorable, but heat release property and touch feeling of the user are deteriorated.

The proportion of the solid metal particles in the particulate filler of the present invention is preferably 100 volume % from the viewpoint of lightness of the pillow, heat release property of the pillow and simplification of its manufacturing process. However, other particulate fillers can be contained up to about 50 volume % to a degree that lightness of the pillow and heat release property of the pillow are not worsened significantly.

As other particulate fillers, in a case that lightness and heat release property of the pillow are emphasized, a particulate filler containing aluminum (specific weight: 2.70, heat conductivity: 230 W/m·k) having a little higher specific weight and a little higher heat conductivity than magnesium can be favorably used. In a case that lightness and cushioning properties of the pillow are emphasized, resin foam bodies of polyurethane, polystyrene, rubber and the like can be favorably used.

The second feature of the present invention is that a pillowcase having a three-dimensional knit structure formed of two layers of knit fabric which are an outer knit fabric and an inner knit fabric and a connecting thread connecting the two layers of knit fabric is used.

Figure 3A:
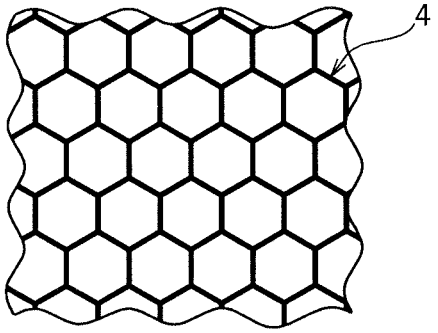
FIG. 3 is an example of a pillowcase which can be used in the present invention, and FIG. 3(*a*) is a plan view of the outer knit fabric, FIG. 3(*b*) is a plan view of the inner knit fabric, and FIG. 3(*c*) is a cross-sectional view.
Figure 3B:
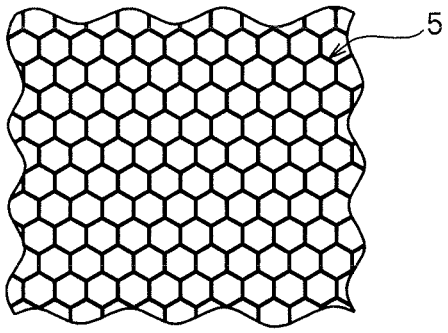
Figure 3C:
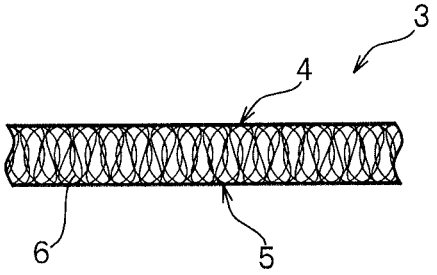

FIG. 3 shows the pillowcase favorably used for the pillow of the present invention. The pillowcase 3 has the three-dimensional knit structure formed of the two layers of knit fabric which are the outer knit fabric 4 and the inner knit fabric 5 and the connecting thread 6 connecting the two layers of knit fabric.

In the pillow of the present invention, the pillowcase covering the particulate filler containing Mg solid particles is used. By using the pillowcase further having the three-dimensional knit structure formed of two layers of knit fabric which are the outer knit fabric and the inner knit fabric and the connecting thread connecting the two layers of knit fabric, cushioning properties and permeability of the pillow can be improved, and heat release property of the pillow can be further enhanced.

As examples of the pillowcase having such a three-dimensional knit structure, the ones disclosed in JP2005-152480A, JP2007-215789A and JP2007-301006A can be favorably used.

In the pillowcase having the three-dimensional knit structure, an interval of the knitted stitches in the inner knit fabric is preferably equal to or smaller than a half of the minimum particle size of the particulate filler because the inner knit fabric is required to perform a function of covering and sealing the particulate filler. As for the outer knit fabric, an interval of the knitted stitches is preferably small so that the stitches are not marked on the user's face after the user contacted his face on the pillow while sleeping.

As mentioned above, the first feature of the present invention is that Mg solid particles which are lightweight and have good heat conductivity are used as the filler of the pillow. In order to obtain a pillow further excellent in lightness and cushioning properties, an embodiment (hereinafter, also referred to as "Embodiment A") in which particles having cushioning properties are contained with Mg solid particles as the particulate filler, and/or an embodiment (also referred to as "Embodiment B") in which a layer having cushioning properties is provided as a back surface layer on a back surface side of the top surface layer which is filled with the particulate filler containing Mg solid particles can be favorably employed.

As a material of "the particles having cushioning properties" in Embodiment A, resin foam bodies of polyurethane, polystyrene, rubber and the like can be favorably used. As a material of "the layer having cushioning properties" in Embodiment B, the above-mentioned resin foam bodies, feather and cottons such as natural cotton, polyester cotton or acrylic cotton can be favorably used.

Figure 4:
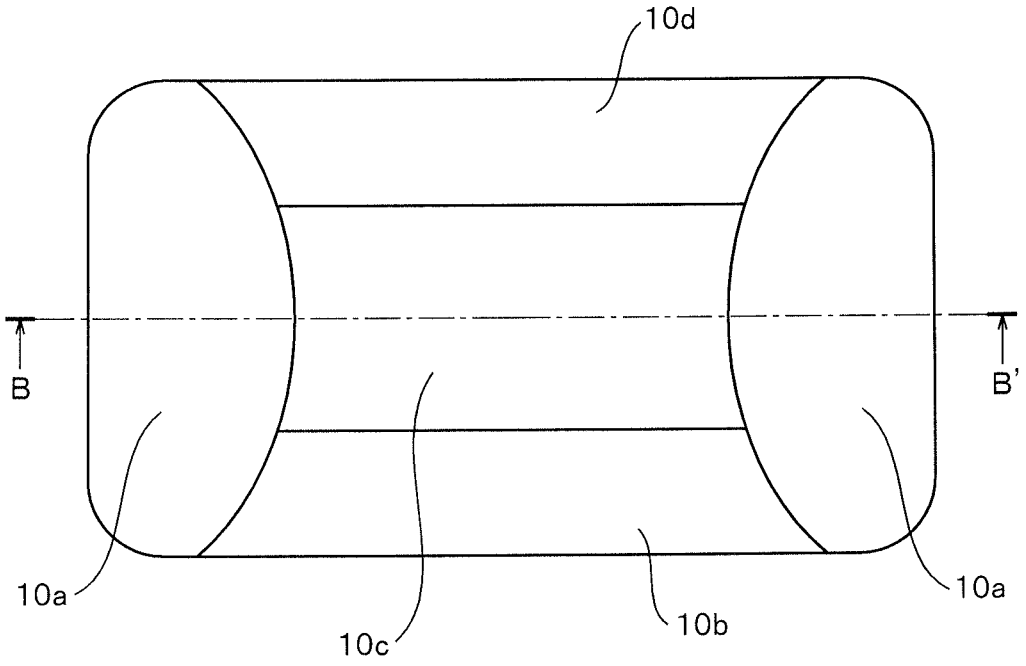
FIG. 4 is a second embodiment of the pillow in the present invention and shows a top view of the pillow body on the top surface side.
Figure 5:
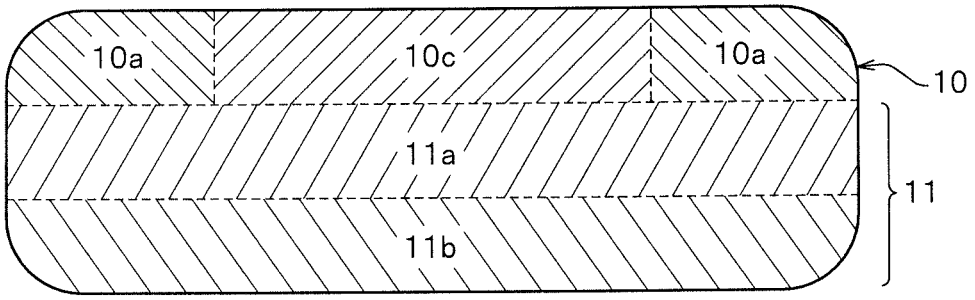
FIG. 5 is a cross-sectional view along the B-B' line in FIG. 4.

The second embodiment of the pillow according to the present invention is shown in FIGS. 4 and 5. In the pillow of the second embodiment, Embodiments A and B are used.

In the pillow body of the second embodiment, as shown in FIG. 5, the pillow body is formed by laminating the top surface layer 10 filled with the Mg solid particles and the particles having cushioning properties, and the back surface layer 11 having cushioning properties and formed of the first back surface layer 11*a* and the second back surface layer 11*b*, serially from the top surface side. In the pillow body, the first back surface layer 11*a* is a layer fixed by sewing to the top surface layer 10, and the second back surface layer 11*b* is a removable layer. Therefore, a height of the pillow can be adjusted by removing the pillowcase and the second back surface layer 11*b*. Further, in a case the second back surface layer 11*b* is made to be a laminated body formed of plural layers, fine-adjustment of the height of the pillow becomes possible.

Further, in the pillow body of the second embodiment, as shown in FIG. 4, the pillow can hold a user's head stably at the center of the pillow by setting a height (hereinafter, referred to as simply "height") of the both side top surface layers 10*a* on the right and left sides of the top surface layer 10 in a vertical direction to be high. Further, the pillow can hold the user's head comfortably at the center of the pillow by setting the height at the center part of the top surface layer 10 in the right and left direction so that the height of the lower side top surface layer 10*b* on the lower side is set to be relatively high, the height of the center top surface layer 10*c* at the center part is set to be relatively low, and the height of the upper side top surface layer 10*d* on the upper side is set to be moderate along a shape of the user from a neck via a back of his head to a top of his head.

The pillow of the present invention enables to the user to have a good sleep by using the Mg solid particles as a particulate filler.

As shown in experimental examples and comparative examples to be described later, when the Mg solid particles are used as the filler of the pillow, the user can have a better sleep compared with a case buckwheat husks are used as the filler.

Although the reason is not sufficiently clarified, it is assumable that, by using the Mg solid particles as the filler of the pillow, not only heat release property of the pillow can be sufficiently enhanced without increasing a weight of the pillow, but also magnesium generates a small amount of hydrogen gas by reacting with moisture such as sweat of the user ($Mg+2H_2O \rightarrow H_2+Mg(OH)_2$), and the small amount of hydrogen gas exerts an effect to improve the user's sleep.

The Mg solid particle of the invention can be manufactured by a method such as dropping molten magnesium into water.

EXPERIMENTAL EXAMPLES AND COMPARATIVE EXAMPLES

The same volume of the fillers 1) and 2) as mentioned below are respectively poured in pillowcases having the same shape and structure to form a pillow A and a pillow B.

1) Filler of pillow A: solid metal particle having 3.0 mm average particle size containing substantially 100 wt % Magnesium (Mg).

2) Filler of pillow B: commercially available buckwheat husk.

Pillow A and pillow B were lent to eight examinees, and a test (also referred to as "sleep test") was conducted under the below conditions.

Examinees sleep in a usual sleep condition using the pillow A and the pillow B.

The sleep test was conducted for four nights using the pillow A on the first night, the pillow B on the second night, the pillow A on the third night and the pillow B on the fourth night.

Sleep of each examinee was evaluated by choosing one of five evaluations as below depending on their feeling just after waking up.

Evaluation A: slept much better than usual;

Evaluation B: slept a little better than usual;

Evaluation C: slept as same as usual;

Evaluation D: slept a little worse than usual; and

Evaluation E: slept much worse than usual.

The results of the sleep test are shown in Table 1 as below.

TABLE 1

| | | Examinee | | | | | | | | |
|---|---|---|---|---|---|---|---|---|---|---|
| | | 1 | 2 | 3 | 4 | 5 | 6 | 7 | 8 | Total |
| Pillow A (filler: Mg solid particle) | Evaluation A | 2 | 2 | | 2 | 2 | 2 | | 1 | 11 |
| | Evaluation B | | | 2 | | | | 2 | 1 | 5 |
| | Evaluation C | | | | | | | | | 0 |
| | Evaluation D | | | | | | | | | 0 |
| | Evaluation E | | | | | | | | | 0 |
| Pillow B (filler: buckwheat husk) | Evaluation A | | | | | | | | | 0 |
| | Evaluation B | | | | | | | | | 0 |
| | Evaluation C | 2 | 1 | | 1 | 2 | 2 | 2 | 1 | 11 |
| | Evaluation D | | 1 | 2 | | | | | 1 | 4 |
| | Evaluation E | | | | 1 | | | | | 1 |

As a whole, comparing the evaluations of the pillow A (Evaluation A: 11, Evaluation B: 5) with the evaluations of the pillow B (Evaluation C: 11, Evaluation D: 4, Evaluation E: 1), the pillow having magnesium (Mg) solid particles as the filler exerts an effect to improve sleep of the users compared with the pillow having buckwheat husks as the filler.

Further, all the eight examinees evaluated the pillow A better than the pillow B. Therefore, it is proved that the pillow having magnesium (Mg) solid particles as the filler exerts an effect to improve sleep of the users compared with the pillow having buckwheat husks as the filler.

INDUSTRIAL APPLICABILITY

The pillow using Mg solid particles as the filler according to the present invention can be favorably used as a pillow at the time of sleep.

REFERENCE SIGNS

1: pillow
2: particulate filler including Mg solid particles
3: pillowcase
4: outer knit fabric
5: inner knit fabric
6: connecting thread
10: top surface layer
10*a*: both sides top surface layer
10*b*: lower top surface layer
10*c*: center top surface layer
10*d*: upper top surface layer
11: back surface layer
11*a*: first back surface layer
11*b*: second back surface layer

The invention claimed is:

1. A pillow including a pillow body and a pillowcase covering the pillow body, the pillow body having a layer as at least a top surface layer, the layer filled with only a particulate filler configured to move and deform in accordance with a shape of the user's head, and the particulate filler containing solid metal particles having an average size at 1.0 to 5.0 mm and containing substantially 100 wt% metal magnesium.

2. The pillow according to claim 1, wherein a proportion of the solid metal particles in the particulate filler is 50 vol% to 100 vol%.

3. The pillow according to claim 1, wherein the particulate filler contains the solid metal particles and particles having cushioning properties.

4. The pillow according to claim 1, wherein the pillow body has a layer filled with the particulate filler containing the solid metal particles as a top surface layer, and has a layer having cushioning properties on a back surface side of the top surface layer as a back surface layer.

5. The pillow according to claim 1, wherein the pillowcase has a three-dimensional knit structure which is formed of two layers of knit fabric which are an outer knit fabric and an inner knit fabric and a connecting thread connecting the two layers of knit fabric.

6. The pillow according to claim 5, wherein an interval of the knitted stiches of the inner knit fabric is equal to or smaller than a half the smallest particle size of the particulate filler.

7. The pillow according to claim 2, wherein the particulate filler contains the solid metal particles and particles having cushioning properties.

* * * * *